United States Patent [19]

Bosi

[11] Patent Number: 4,976,675

[45] Date of Patent: Dec. 11, 1990

[54] AUTOMATIC MACHINE FOR FOLDING FLAT PRE-CREASED DIE-CUTS INTO TUBULAR SHAPE

[75] Inventor: Gianni Bosi, Zola Predosa, Italy

[73] Assignee: Verpac, S.p.A., Italy

[21] Appl. No.: 412,442

[22] Filed: Sep. 26, 1989

[30] Foreign Application Priority Data

Sep. 30, 1988 [IT] Italy ..... 3609 A/88

[51] Int. Cl.[5] ..... B31B 3/06; B31B 3/26; B31B 3/62

[52] U.S. Cl. ..... 493/295; 493/122; 493/124; 493/127; 493/177; 493/179

[58] Field of Search ..... 493/122, 123, 124, 125, 493/126, 127, 128, 477, 178, 179, 295

[56] References Cited

U.S. PATENT DOCUMENTS

| | | | |
|---|---|---|---|
| 3,130,650 | 4/1984 | Shields | 493/295 |
| 3,516,336 | 6/1970 | Maulini et al. | 493/178 |
| 4,349,345 | 9/1982 | Bodendoerfer | 493/295 |
| 4,588,393 | 5/1986 | Cogswell et al. | 493/179 |
| 4,661,091 | 4/1987 | Moen | 493/126 |
| 4,708,707 | 11/1987 | Koike et al. | 493/125 |
| 4,713,048 | 12/1987 | Reil et al. | 493/302 |
| 4,917,663 | 4/1990 | Pazdernik | 493/124 |

*Primary Examiner*—William E. Terrell

*Attorney, Agent, or Firm*—Banner, Birch, McKie & Beckett

[57] ABSTRACT

The automatic machine comprises a magazine, dispensing die-cuts pre-creased longitudinally with fold lines providing divisions between at least four side panels and a securing flap, suckers by which the die-cuts are picked up from the magazine, and a revolver with radial grippers. In addition, use is made of a conveyor by which the die-cut is transferred forcibly from the suckers to the revolver and bent into U-shape at the same time, and the jaws of each gripper incorporate suction passages emerging along the edges parallel to and farthest from the axis of rotation of the revolver, which firmly withstand the action of first and second folders used to press down the securing flap and the end panel; thus, the die-cut is positively handled and conveyed during its entire passage through the machine.

15 Claims, 5 Drawing Sheets

AUTOMATIC MACHINE FOR FOLDING FLAT PRE-CREASED DIE-CUTS INTO TUBULAR SHAPE

BACKGROUND OF THE INVENTION

The invention relates to an automatic machine for folding flat die-cuts into tubular shape, and in particular, die-cuts with pre-creased fold or hinge lines serving to mark out the sides and securing flaps of a box type container.

The prior art embraces various machines by which box die-cuts can be folded into a tubular shape; the flat forms are punched from rigid material and provided at least with creases separating a number of adjacent parallel side panels, and a securing flap parallel to the side panels.

Die-cuts are stacked generally in a magazine loader and removed one by one from the base of the stack. Removal is effected in most instances by suction means that latch onto one side panel of the die-cut and are then traversed through an opening shaped in such a way as constrains the rigid material to fold along the two longitudinal creases which flank the side panel engaged by the suction means.

With these first folds effected, the suction means are traversed further to a revolver, or revolving head, provided with radial grippers by which the die-cuts are taken up.

The circumference of the revolver is fitted with fixed and/or movable folding means operating in conjunction with support means, generally capable of movement between two limit positions, by which the securing flap and the endmost side panel are turned in toward the center of the die-cut, thereby completing the tube.

It will be observed that, with machines of the type in question, removal of the die-cut from the bottom of the stack is brought about by discrete movements first in one direction, whereby the die-cut is picked up and transferred to a successive station, then in the opposite direction, in order to return to an at-rest condition in which the suction means are repositioned in contact with the next die-cut, at the bottom of the stack. Thus, given that the transfer trajectory of the die-cuts is intercepted by the suction means, there can be no movement of each successive die-cut until the suction means have been returned to the at-rest position.

Clearly enough, such an arrangement involves long operating times, low productivity and considerable noise, as well as imposing limits on the maximum traverse speeds of the various components invested with reciprocating movement.

Accordingly, the object of the invention is to provide an automatic machine capable of operating continuously, hence of overcoming these drawbacks.

SUMMARY OF THE INVENTION

The stated object is realized with a machine according to the present invention.

Such a machine is of the type comprising a magazine loader in which the die-cuts are stacked, means for picking up the die-cuts from the magazine, and a revolver provided with radial grippers, wherein use is made of positive conveying and U-bending means between the pick-up means and the revolver, and the grippers of the revolver incorporate suction means, located along their farthest edges parallel to the axis of rotation of the revolver, which serve to lay a firm hold on the side panels of the die-cut contiguous to that coinciding with the base of the U-bend and adjacent to the outermost fold creases, and to provide reaction means for first and second folders installed along the circular path described by the revolver, by which an outer securing flap and the side panel farthest from the flap are turned inwards toward the base of the U-bend.

One advantage afforded by the invention consists essentially in a combination of simplicity and versatility that renders the automatic machine highly effective and competitive.

BRIEF DESCRIPTION OF THE DRAWINGS

The invention will now be described in detail, by way of example, with the aid of the accompanying drawings, in which.

DESCRIPTION OF THE PREFERRED EMBODIMENTS

Figure 1:
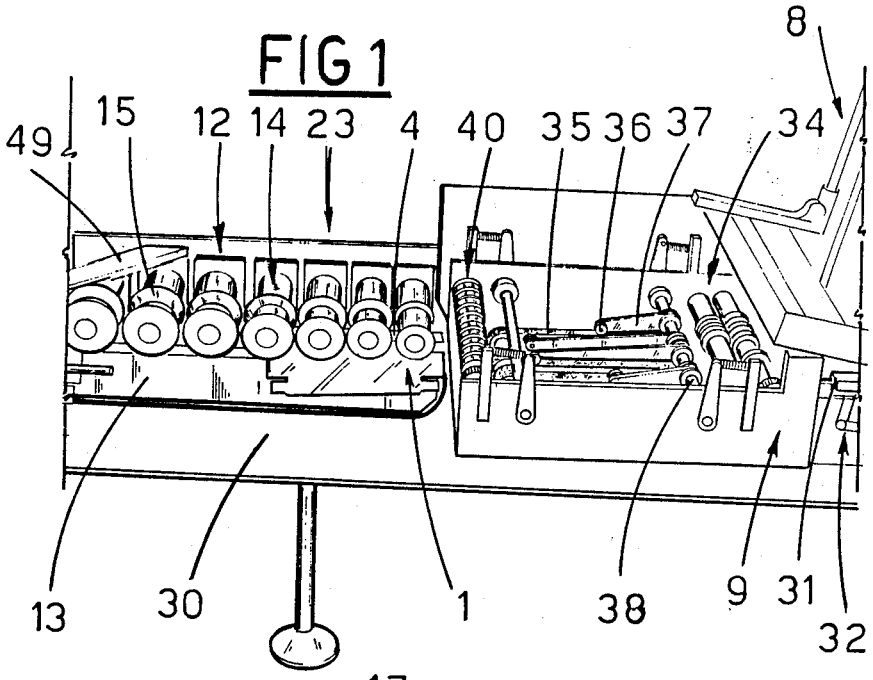
FIG. 1 is an overall schematic representation of the machine disclosed, viewed in side elevation.

With reference to FIG. 1, the machine according to the present invention, denoted 23 in its entirety, essentially comprises (in order of progression) a magazine or loader 8 in which the die-cuts 1 are stacked, means 9 by which the die-cuts are picked up from the magazine, means 12 by which each die-cut picked up is bent into U-shape, and a revolver, or revolving head 10, all of which are carried by a bearing structure 30.

The die-cuts 1 are stacked in the magazine 8 in contact one with the next by way of their unfolded flat surfaces.

Each die-cut 1 is pre-creased with longitudinal fold lines 2 that create four side panels 3, 4, 5 and 6 and a securing flap 7, disposed parallel and contiguous, and with the securing flap 7 outermost on one flank.

The aforementioned pick-up means 9 consist in at least one pair of suckers 31 positioned at the base of the magazine 8 and mounted to an articulated quadrilateral linkage 32 carried by the bearing structure 32. The suckers 31 are moved through a curved trajectory by the quadrilateral linkage 32, alternating between a pick-up position located beneath the magazine 8, in which contact is made with the die-cut 1 at the bottom of the stack, and a position at which the die-cut 1 currently held is released and taken up between pairs of cylindrical pinch rollers 34 disposed in vertical alignment and in mutual contact via common generators. The bottom or top rollers 34 (or both) will be power driven, such that die-cuts 1 received from the suckers 31 are conveyed positively to the bending means 12. 35 denotes a set of belts running forward from the pinch rollers 34 in the direction of the bending means 12 and the revolver 10. Positioned above the belts 35 are freely revolving rollers 36, each one mounted to the projecting end of a respective bail arm 37 hinged by its remaining end to a horizontal shaft 38 disposed transverse to the belts 35 and tensioned by spring means (not illustrated) in such a way as to urge the roller 36 into contact with the belt beneath. Accordingly, die-cuts 1 conveyed along the belts 35 are held positively between the surfaces of the belts and the rollers 36.

40 denotes further pinch rollers located at the runout from the belts 35, by which each emerging die-cut 1 is taken up and conveyed positively into the bending mean 12.

The bending means 12 comprise positive conveyor means denoted 13 and 14, and a pair of helically shaped guide-and-fold channels located on either side of the positive conveyor means 13 and 14.

In the embodiment illustrated, such means 13 and 14 take the form, respectively, of a horizontal bar 13 of right quadrangular section and a plurality of power driven rollers 14 located directly above and disposed with their axes normal to the bar 13.

The rollers 14 are distanced from the bar 13 by an amount substantially less than the thickness of one die-cut 1, and provided each with two circular flanges 15 disposed one on either side of the bar and extending downward beyond the top surface of the bar 13. The height of the flanges 15 on any single roller 14, considered in relation to the cylindrical surface of the roller 14, is less than that of the flanges 15 of the roller 14 immediately adjacent on the side nearest the revolver 10.

In addition, the inward facing surfaces of each two circular flanges 15 are angled in relation to the cylindrical part of the respective roller 14, to a degree less than that exhibited by the flanges 15 of the roller immediately adjacent on the revolver side. Thus it is that the bar 13 and rollers 14 combine to create two guide-and-fold channels of helical embodiment, one on either side of the bar. The width of the bar 13, and the distance between the circular flanges 15 as measured across the exposed cylindrical surface of the roller 14, will be substantially equal to the width of the central panel 5 of the die-cut 1, thereby ensuring that contact is made with the flanges 15 only by way of the two panels 4 and 6 immediately on either side of the central panel 5.

49 denotes a clevis type element located following the final roller 14 of the folding means 12, which is carried rigidly by the bearing structure 30 with its two members positioned one on either side of the end of the bar 13 nearest the revolver 10.

16 denotes an entry elevator located in alignment with the bar 13 and beneath the revolver 10, which consists in a horizontal plate carried by the top end of a vertical rod 45, carried in turn by the bearing structure 30; the horizontal plate exhibit transverse shape identical to that of the bar 13, and is capable of movement between a lowered limit position of total alignment with the bar 13, and a raised position shortly to be described more fully. The revolver 10 is rotatable about a horizontal axis disposed parallel with the bar 13, and carries a plurality of radial grippers 11 designed to lay hold on each die-cut 1 invested with 'U' shape and brought onto the elevator 16, by closing on the panels denoted 4 and 6.

Each of the two jaws of the single gripper 11 is provided along its outer edge, parallel to the axis of rotation of the revolver 10, with suction means denoted 17; these take the form of a plurality of holes 41 formed in the relative jaw 22 and emerging from its inwardly directed face.

Each jaw 22 is carried by a respective pivot 50 disposed parallel with the axis of the revolver 10. The pivots 50 are mounted to the transverse web **10*a* of a cylindrical body 10*b* that is supported axially and rotatably, and to a fluid-tight fit, internally of a housing 10*c* rigidly attached to the bearing structure 30 (see FIG. 4). The housing 10*c* and the cylindrical body 10*b* provide the basic construction of the revolver 10, which incorporates means (not illustrated) located internally of the housing 10*c*, serving to index the cylindrical body 10*b* about its own axis of rotation in time with the movement of the quadrilateral linkage 32**.

Figure 4:
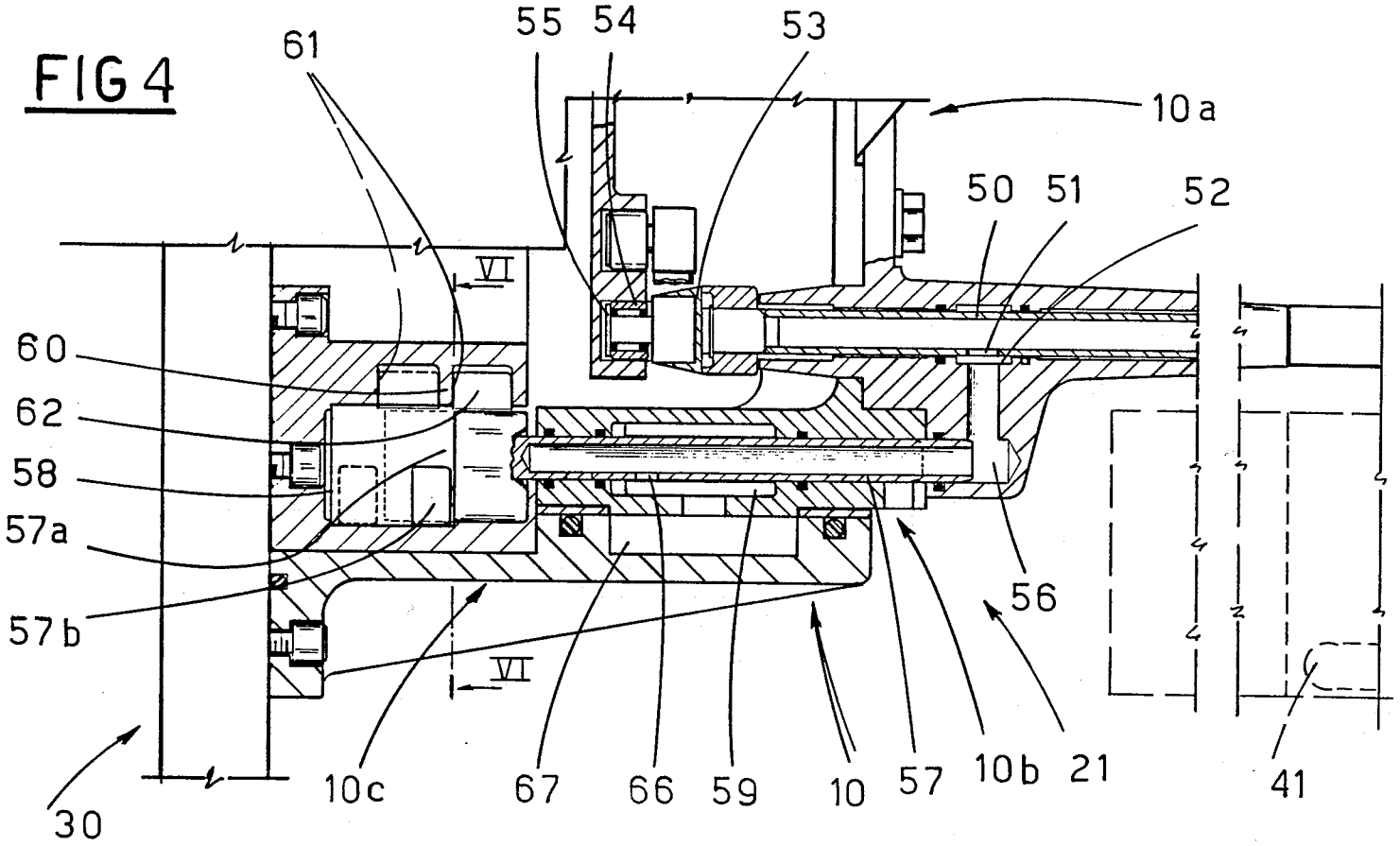
FIG. 4 is the axial section through an alternative embodiment of the revolver of FIG. 1, illustrated schematically with certain parts omitted.

Each pivot 50 affords an axial bore connecting on the one hand with the suction holes 41 provided in the jaw 22, and on the other, by way of a radial passage 51, with an annular chamber 52 afforded by the cylindrical body (FIG. 4).

Figure 5:
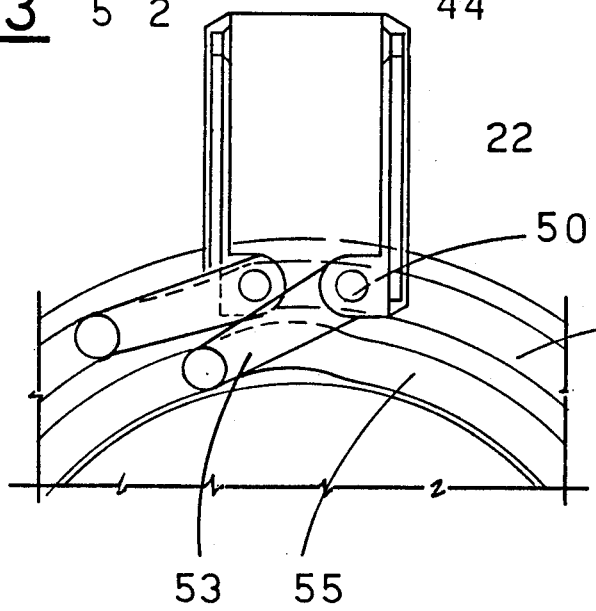
FIG. 5 is the frontal elevation of a detail of the revolver of FIG. 4.

53 denotes an arm, of which one end is associated with the end of the pivot 50 located internally of the cylindrical body **10*b* and the housing 10*c*; the remaining end of the arm carries a cam follower 54 rolling in a relative cam groove 55 afforded by the housing 10*c*** (see also FIG. 5).

It will be observed from FIG. 5 that there are two cam grooves 55, one for each jaw 22 of the single gripper 11 profiled in such a way that the jaws remain normally closed except in two positions, one of which being that when the gripper is in vertical alignment with the elevator 16 and at its minimum possible height during rotation of the revolver; the remaining position, lying some 270° clockwise from the minimum height position, coincides with a station at which the tube folded from the die-cut 1 is ultimately released (FIG. 5).

Both the positions in question coincide with one of the pauses in the indexed motion of the cylindrical body **10*b***, and are referred to hereinafter as entry and exit stations.

The annular chambers 52 relative to the pivots 50 of each gripper 11 connect with one end of a common horizontal bore 56 afforded by the cylindrical body **10*b* and slidably accommodating a hollow shaft 57 of which the end opposite from the annular chamber 52 emerges into a further annular chamber 58 afforded by the housing 10*c*. It will be observed that the bore 56, which remains permanently in communication with the hollow interior of the slidable shaft 57, exhibits a widened intermediate stretch serving to create an annular chamber 59 which in turn is in permanent communication with a toroidal chamber 67 formed in the housing 10*c*** and connected with a source of negative pressure (not illustrated).

The end of each hollow shaft 57 occupying the annular chamber denoted 58 carries a relative fixed shoe **57*a* provided with a pair of wheels 57*b* that roll on the cylindrical surface of larger diameter afforded by the chamber 58. The cylindrical surface of smaller diameter is divided by a circular rib 60 combining with the flat walls of the chamber 58 to create two toroidal tracks 61 in which a freely rotating follower 62, also carried by the shoe 57*a***, is able to roll.

The rib 60 affords an opening, coinciding with the position assumed by the shoe 57*a* at each pause in the indexed movement of the cylindrical body 10*b*, through which the follower 62 is able to cross over from one track 61 to the other, as will shortly be described.

Figure 6:
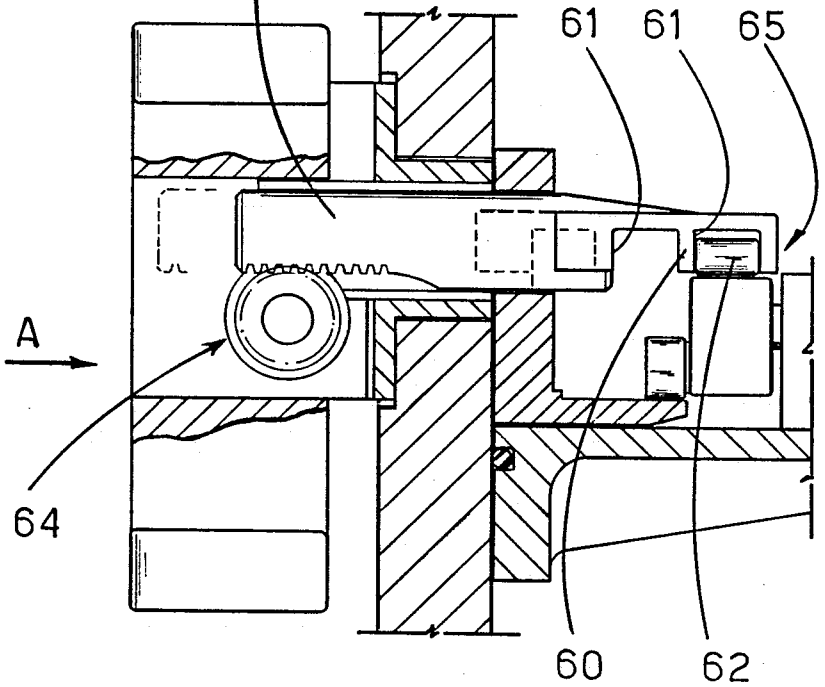
FIG. 6 shows a detail of the section through VI—VI in FIG. 4.
Figure 7:
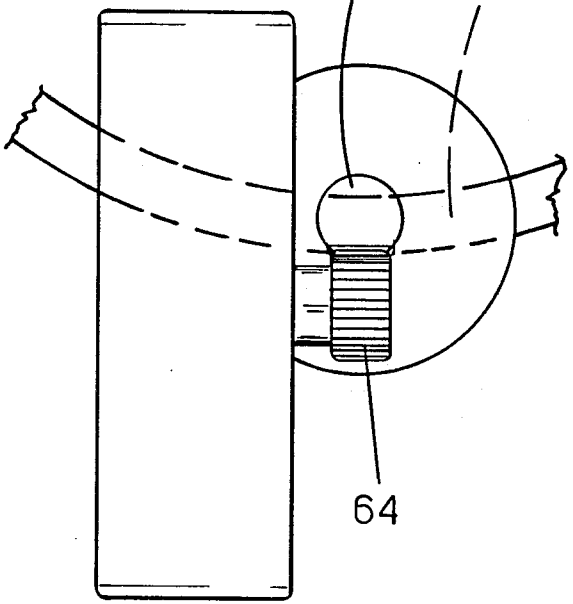
FIG. 7 is the view of FIG. 6 from standpoint A, with certain parts omitted better to reveal others.

The housing 10*c* further comprises bores located at the entry and exit stations, disposed parallel to its own axis, each one of which accommodates a sliding bolt 63 (FIG. 6) capable of axial movement between two limit positions produced by the action of relative means 64, for example, such as a gear meshing with a correspondingly toothed part of the bolt 63; more exactly, the bolt 63 reciprocates between an at-rest position and a working position, and is of shape such as to restore continuity of the smaller-diameter cylindrical surface of the annular chamber 58 when in the at-rest position. The bolt 63 at the entry station also exhibits a projection 65 designed to ensure continuity of the circular rib 60, whilst the remaining bolt 63 is embodied without such a projection, for a reason that will be made clear in due course.

66 denotes at least one radial hole located in an intermediate position along each hollow shaft 57, serving to connect the hollow interior of the shaft with the negatively pressurized annular chamber 59 whenever the respective follower 62 is in motion along the track 61 positioned farthest from the bearing structure 30 (FIG. 4); accordingly, the hollow shaft 57 provides on/off means which are denoted 21 in their entirety.

18 and 19 denote first and second folding means located along the circular path described by the revolver 10, and more exactly, positioned adjacent to the uppermost generator of the revolver's outer perimetral dimension. The first such means 18 are embodied as a plate lying parallel to the axis of rotation of the revolver 10 and carried by the ends of a pair of quadrilateral linkages 42 anchored to the bearing structure 30; the linkages 42 will be proportioned in such a way that the plate 18 can be moved through a curved trajectory which becomes substantially tangential at one point to the outer perimetral dimension of the revolver 10.

The second folding means 19, which also consist in a plate lying parallel to the axis of rotation of the revolver 10, are carried by a pair of rods 43 articulated at one end to the bearing structure 30 and capable of movement (generated by means not illustrated) between an at-rest position, in which the plate 19 is held essentially vertical, and a working position in which the plate is essentially horizontal. The rods 43 are proportioned to produce a trajectory whereby the plate 19 intercepts the die-cut 1 across the panel denoted 3.

The machine will also comprise means for applying glue, located between the first and second folding means, which are neither described nor illustrated, being conventional; at all events, such means will be timed to operate in conjunction with the various movements of the machine.

44 denotes one of two curved guide strips located beyond the working position assumed by the second folding means 19, along the circular path followed by the die-cut 1, which are matched through a given distance to the outer perimetral dimension of the revolver 10 for a reason that will shortly be described.

In operation of the machine 23 according to the invention, die-cuts 1 are picked up from the lower end of the magazine 8; more exactly, the suckers 31 latch onto and draw away the die-cut 1 at the very bottom of the stack. Once taken through the curved trajectory by the suckers 31 as mentioned at the outset, the single die-cut 1 is released, taken up by the pinch rollers 34 and conveyed positively (i.e. forcibly) onto the belts 35, whereupon the positive conveying action is continued by the belts and the bail rollers 36 above, and thereafter by the second set of pinch rollers 40, from which the die-cut 1 is transferred onto the bar 13 and under the first of the bending rollers 14. At this point, the central panel 5 of the die-cut 1 lies in flush contact with the bar 13, and, pinched between the bar and the cylindrical surface of the rollers 14, begins moving along the bar toward the revolver 10. During this movement, the panels 4 and 6 contiguous on either side are engaged by the side flanges 15 of the rollers and forced by the increasing depth and narrowing angle to bend downwards from the two creases 2 common to the central panel 5. Bent fully into a 'U' profile at this point, the die-cut 1 is conveyed ultimately by the end roller 14 beneath the clevis 49 and onto the entry elevator 16. In a movement timed with that of the revolver 10, the elevator is raised toward the gripper 11 currently stationed above, of which the jaws 22 are spread apart by the combined action of the followers 54 and the relative cam grooves 55, in such a way as to lift the central panel 5 of the die-cut 1 into contact with a flat base element 25 located between the two jaws 22 of the gripper 11.

Prior to this point, the hollow shaft 57 relative to the gripper 11 at the entry station will have been positioned with its follower 62 occupying the track 61 nearest the bearing structure 30 (the left hand, as viewed in FIG. 4), isolating the radial hole 66, hence the suction holes 41 in the jaw 22, from the negatively pressurized chamber 59.

As soon as the elevator 16 gains the raised limit position, the sliding bolt 63 serving the entry station will be moved into its working position, with the result that its projection 65 engages the follower 62 and the hollow shaft 57 is shifted across to the point where the follower 62 occupies the right hand track 61, as in FIG. 4.

Figure 2:
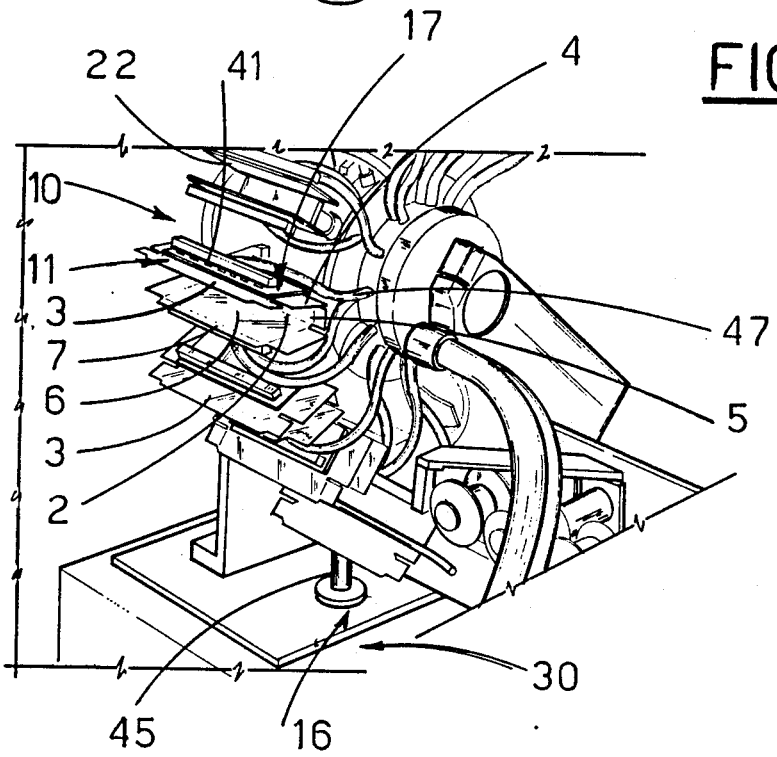
FIGS. 2 and 3 are frontal perspectives of a revolver forming part of the machine of FIG. 1, viewed from a side angle and a central standpoint, respectively.
Figure 3:
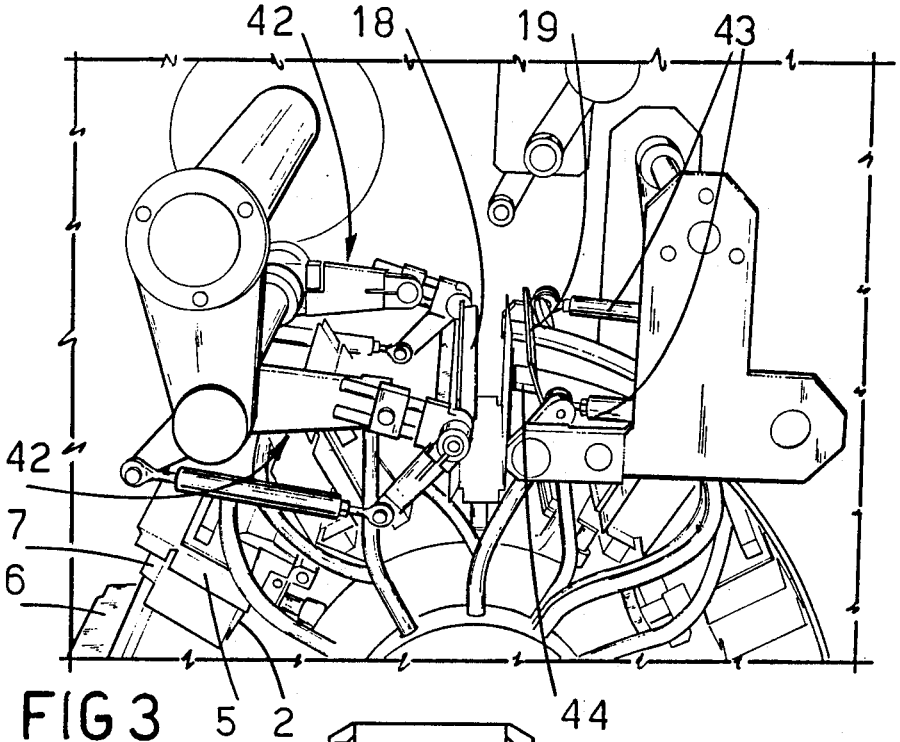

With the suction holes 41 of the gripper jaws 22 now connected up to the negative pressure source, the corresponding panels 4 and 6 of the U-shaped die-cut are held firmly by the jaws before moving away from the entry station. Thus held, the die-cut is indexed together with the cylindrical body 10*b* (clockwise, as viewed in FIG. 2) and if appropriate, brought into a work station (not illustrated) at which a commodity for packaging is positioned in the U-fold.

The bolt 63 at the entry station is now slid back to its at-rest position in readiness to engage the next follower 62 indexed through.

The die-cut 1 now encounters: the first folding means 18, which press down on the securing flap 7; the glue applicator means, by which a smear of suitable adhesive is spread over the outward facing surface of the flap 7; and then the second folding means 19, which press the remaining panel 3 of the die-cut 1 down over the flap 7 and into contact with the adhesive. Thereafter, the tubular shape is held firm by the guide strips 44 in order to enable a satisfactory bond of the flap 7 with the panel 3 to which adhesive has been applied.

The strips 44 terminate at a given point prior to the exit station, where the relative bolt 63 will now slide into its operating position; the effect of the movement of this bolt from the at-rest to the operating position is exactly the opposite to that produced by the bolt 63 at the entry station, inasmuch as this movement is designed to return the hollow shaft 57 to an 'off' condition, with the radial hole 66 blocked, and the follower 62 engaged in the left hand track 61 (phantom line, FIG. 4).

As the bolt 63 shifts, the jaws 22 will also spread and enable release of the folded die-cut 1 from the gripper 11 for removal by means not illustrated in the drawings. If for any given reason the die-cut 1 should separate from one jaw 22 only, the relative suction holes 41 will be vented to atmosphere and enable pressure to rise internally of the bore 56, and with different pressure levels being brought into play (atmospheric pressure impinging axially on the end wall of the hollow shaft 57 from inside will tend to displace the shaft in the direction of the chamber 58, whereas no movement is produced by circumferential exposure to negative pressure on the outside), the hollow shaft 57 will move to the left as soon as there is a pause in the movement of the cylindrical body 10*b* and the follower 62 finds a gap in the circular rib 60. The atmospherically pressurized bore 56 thus becomes isolated from the negatively pressurized annular chamber 59, given that leftwards movement of the hollow shaft 57 has the effect of blocking the radial hole 66, and one is therefore able to avoid pressure rising in the main suction chamber 67, hence at the holes 41 of other grippers 11 still holding their respective die-cuts 1.

Figure 8:
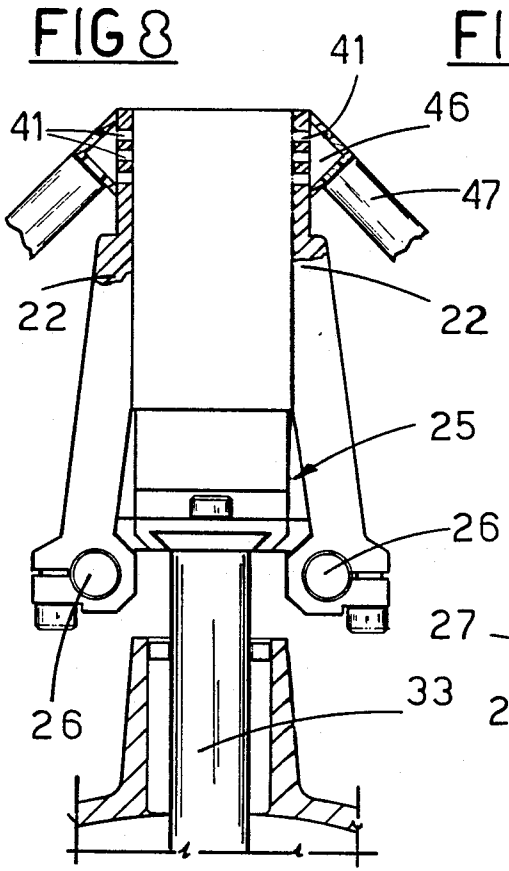
FIG. 8 shows an embodiment of the grippers of FIG. 2, viewed in frontal elevation with certain parts cut away and revealed in section.

In an alternative embodiment of the machine shown in FIG. 8, the suction holes 41 pass through the jaws 22 from side to side, emerging on the reverse sides into chambers 46 that connect via passages 47 with a valve incorporated into the cylindrical body 10*b*. The valve consists substantially in an annular chamber extending clockwise (as viewed in FIG. 2) through 270° departing from the bottom generator of the revolver 10, and connected permanently with a source of negative pressure (not illustrated); the passages 47 will connect with the valve by way of automatic on/off means which would be equivalent to the hollow shaft 57 of FIG. 4, and therefore require no further description. In this type of embodiment, the bore 56 and the suction holes 41 connect by way of the passages 47.

Figure 9:
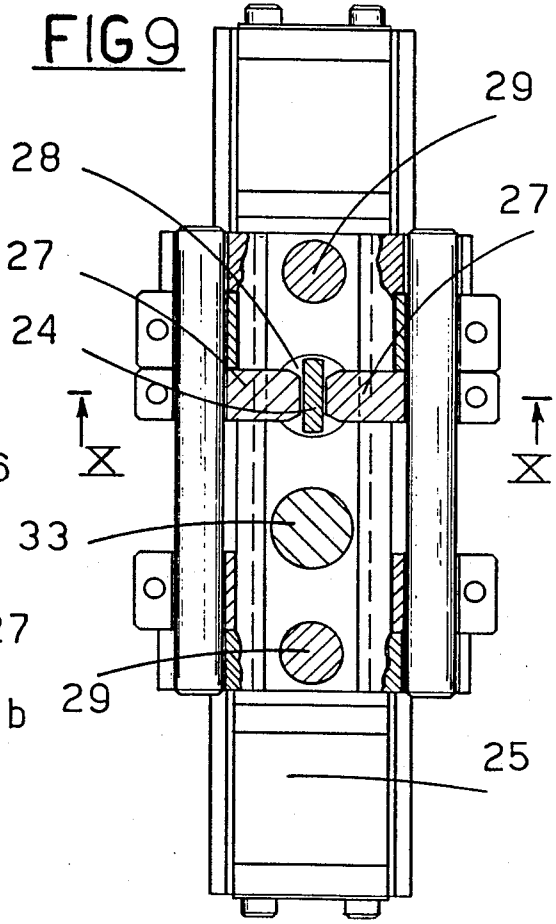
FIG. 9 shows the grippers of FIG. 8 in plan, with certain parts cut away and revealed in section.

The flat base element 25, to which each jaw 22 is anchored via the edge parallel and nearest to the axis of rotation of the revolver 10, is disposed at right angles to the jaw 22 and attached to the outer end of a radial control rod 33 carried by the revolver 10, and in addition, rigidly attached to the top ends of a pair of parallel radial rods 29 affording support to the gripper 11, which are carried by and axially slidable in relation to the revolver 10. In this particular embodiment, the single jaw 22 is attached to a pivot 26 disposed parallel with the axis of rotation of the revolver and carried by the flat base 25 in freely rotatable manner. The jaws 22 of each gripper 11 are provided with respective transverse projections 27 extending one toward the other, the two ends locating freely in two sockets 28 afforded by the end of a second radial control rod 24 carried by the revolver 10. The control and support rods 33, 24 and 29 are all parallel, with the support rods 29 flanking the control rods 24 and 33 on either side, as shown in FIG. 9.

Figure 10:
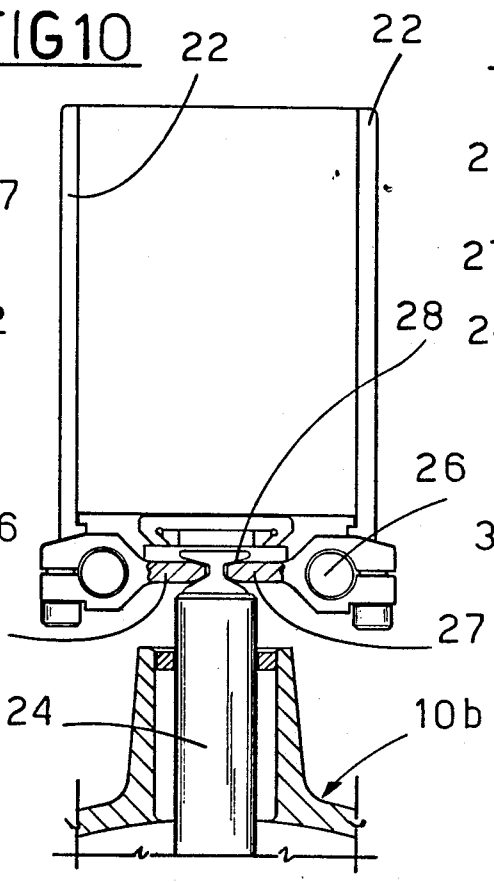
FIG. 10 is the section through X—X in FIG. 9.

The control rods 24 and 33 are capable of movement between two limit positions, respectively near to and distanced from the revolver 10. Movement of the one rod 33 away from the axis of rotation of the revolver 10 produces a corresponding movement of the relative gripper 11 (FIG. 8), whereas movement of the other rod 24 away from the axis of rotation of the revolver causes the jaws 22 of the relative gripper 11 to spread apart (FIG. 10).

The control rods 24 and 33 might be those of a pair of fluid power cylinders, or alternatively, simple mechanical components the innermost ends of which act as cam followers engaging with respective cam profiles located internally of the revolver 10 and rigidly associated with the bearing structure 30. The operation of this embodiment differs from that described above insofar as the jaws 22 are capable not only of drawing together and spreading apart, but also of effecting a radial movement in relation to the cylindrical body 10*b*.

What is claimed:

1. An automatic machine for folding flat die-cuts into tubular shape, utilizing die-cuts pre-creased at least with parallel longitudinal fold lines providing division into at least five contiguous and parallel panels of which one functions as a securing flap, comprising:

a magazine into which and from which die-cuts are stacked and dispensed, respectively;

means by which the die-cuts are picked up from the bottom of the magazine;

a revolving head provided with a plurality of radial grippers designed to engage at least the panels of the die-cut lying immediately on either side of the central panel;

means located between the pick-up means and the revolving head, by which die-cuts received from the pick-up means with the securing flap positioned so as to lead, considered in relation to the direction of rotation of the revolving head, are bent into a U-shape by rotation of the outer panels in relation to the central panel, comprising positive conveyor means by which the die-cuts are engaged through contact with the central panel and conveyed positively in a given plane, operating in conjunction with helically shaped guiding and folding elements located one on either side of the conveyor means and embodied as channels lying in the same plane as that occupied by the die-cuts at the end nearest the pick-up means and in planes perpendicular thereto at the end nearest the revolving head, in such a manner as to engage at least the panels contiguous to the central panel and bend them at right angles to the central panel as the die-cut progresses along the conveyor means;

first and second folding means located along the circumference of the revolving head, by which the outermost panel constituting the securing flap is folded in first over the space encompassed by the 'U', and the remaining outermost panel then folded over and onto the securing flap;

means for applying glue located between the first and second folding means and serving to dispense adhesive onto the outward facing surface of the folded securing flap;

elevator means positioned in longitudinal alignment with the conveyor means, serving to place the U-shaped die-cuts between the jaws of relative grippers carried by the revolving head, and capable of movement between a lowered position in which no obstruction is offered to the die-cut proceeding along the conveyor means, and a raised position between the jaws of one of the grippers;

suction means associated with each radial gripper, located along the outer edges parallel to the axis of rotation of the revolving head and connected by way of a valve to a source of negative pressure, designed both to engage the die-cut by way of the panels contiguous to the central panel at points along and in close proximity to the creased fold lines that separate them from the outer panels, and to provide support means for the first and second folding means and the glue applicator means;

on/off means located between the suction means and the valve, which serve to isolate the gripper from negative pressure at least in the event that the hold on a die-cut is wholly or partly unsuccessful.

2. A machine as in claim 1, wherein the positive conveyor means comprises:

a fixed bar of right quadrangular section disposed parallel to the axis of rotation of the revolving head;

a plurality of power driven rollers positioned above the bar, each exhibiting two circular flanges disposed one on each side of the bar and of height progressively increasing along the path followed by the die-cuts, the opposed surfaces of which exhibit a rectilinear profile that is angled in relation to the exposed part of the relative roller to a degree progressively narrowing together with the increase in height, thereby creating a helical channel on each side of the bar;

wherein the width of the bar and the distance separating the opposed circular flanges, measured across the exposed part of the roller, are substantially equivalent to the width of the central panel of the die-cut.

3. A machine as in claim 1, wherein the on/off means relative to each gripper consist in a hollow shaft accommodated slidably and to a fluid-tight fit in a bore afforded by a rotatable body of the revolving head and connected permanently by one end to the suction means, and provided with a radial hole emerging externally into an annular chamber afforded by the rotatable body, which encircles the shaft and is connected permanently to a chamber afforded by a fixed housing of the revolving head, connected permanently in its turn with a source of negative pressure, and internally, into a stopped axial cavity encompassed by the shaft itself, of which the open end emerges into the end of the bore connecting with the suction means, in such a way that the shaft is capable of axial movement in response to increased pressure internally of the bore caused by separation of a die-cut from the relative suction means, between an extended working limit position, in which the radial hole remains in communication with the annular chamber, and a retracted and at-rest limit position in which the radial hole is blocked by the wall of the bore; and wherein control means are provided by which the hollow shaft can be moved axially from one limit position to the other in order to activate or deactivate the suction means.

4. A machine as in claim 1, wherein the jaws of each gripper are mounted to respective pivots carried by a rotatable body of the revolving head, and use is made of control means to invest the pivots of each gripper with two successive angular movements in opposite directions, timed to coincide with entry and exit stations of the machine, in such a way that the relative jaws are spread apart and then drawn together.

5. A machine as in claim 1, wherein the jaws of each gripper are mounted to respective pivots carried by a rotatable body of the revolving head, and use is made of control means to invest the pivots of each gripper with two successive angular movements in opposite directions, timed to coincide with entry and exit stations of the machine, in such a way that the relative jaws are spread apart and then drawn together, and wherein the pivots are embodied axially hollow, each encompassing a cavity connected with the on/off means on the one hand, and on the other, with suction means that consist in a plurality of holes departing from the axial cavity of the pivot and emerging along the far inwardfacing edge of the relative jaw.

6. A machine as in claim 4, wherein the control means are embodied as cam followers associated with respective arms extending radially from the pivots, and cam grooves afforded by a fixed housing located internally and forming part of the revolving head.

7. A machine as in claim 5, wherein the control means are embodied as cam followers associated with respective arms extending radially from the pivots, and cam grooves afforded by a fixed housing located internally of and forming a part of the revolving head.

8. A machine as in claim 1, wherein the grippers are capable of radial movement toward and away from the revolving head.

9. A machine as in claim 1, wherein the grippers are capable of radial movement toward and away from the revolving head, and at the same time, of spreading apart in such a way as enables the jaws to admit a die-cut folded into 'U' shape, and to release a die-cut folded ultimately into tubular shape.

10. A machine as in claim 8, wherein each gripper is attached to the projecting end of at least one relative control rod extending radially from the revolving head and capable of axial movement between two limit positions corresponding to the limit positions assumed by the gripper.

11. A machine as in claim 9, wherein each gripper is attached by way of a base element, located between the relative jaws, to the projecting end of at least a first control rod extending radially from the revolving head and capable of axial movement between two limit positions corresponding to the limit positions assumed by the gripper, and the jaws are mounted to respective pivots disposed parallel to the axis of rotation of the revolving head and anchored to the base element in such a way that the jaws are rotatable about and together with the respective pivot; and wherein each jaw is provided with a respective transverse projection extending toward the other jaw of the relative gripper, the end of which locates freely in a socket afforded by the end of a second control rod disposed parallel with the first and capable of axial movement between two limit positions, in such a way that movement of the socket causes the relative projection to rotate and shift radially in relation to the second control rod during axial movement of the rod.

12. A machine as in claim 10, wherein the control rod is the rod of a fluid power cylinder.

13. A machine as in claim 10, wherein the remaining, inner end of the radially extending control rod engages a cam profile rigidly associated with a bearing structure by which the revolving head is supported, in such a way that the rod functions as a cam follower.

14. A machine as in claim 11, wherein the first and second control rods are the respective rods of a first and a second fluid power cylinder.

15. A machine as in claim 11, wherein the remaining, inner ends of the first and second radial control rods engage relative cam profiles rigidly associated with a bearing structure by which the revolving head is supported, in such a way that the rods function as cam followers.

* * * * *